United States Patent [19]

Clegg et al.

[11] Patent Number: 4,473,131

[45] Date of Patent: Sep. 25, 1984

[54] THREADED MUFFLER NIPPLE AND BUSHING

[75] Inventors: Michael W. Clegg, Toledo; James E. Gerber, Walbridge; Jon W. Harwood; Clinton R. Hay, both of Toledo, all of Ohio

[73] Assignee: APX Group, Inc., Toledo, Ohio

[21] Appl. No.: 405,922

[22] Filed: Aug. 6, 1982

[51] Int. Cl.[3] ..... F01N 7/18

[52] U.S. Cl. ..... 181/243; 181/228; 285/158; 285/390

[58] Field of Search ..... 285/158, 333, 334, 355, 285/390; 181/232, 241, 243, 282, 227, 228

[56] References Cited

U.S. PATENT DOCUMENTS

| | | | |
|---|---|---|---|
| 165,893 | 7/1875 | Umland . | |
| 1,015,955 | 1/1912 | Helder | 181/232 |
| 1,021,254 | 3/1912 | Larkins | 181/232 |
| 1,296,016 | 3/1919 | Smith . | |
| 1,465,484 | 8/1923 | Richter . | |
| 1,904,675 | 4/1933 | Boyer . | |
| 1,989,595 | 1/1935 | Hedrick | 285/198 |
| 2,179,193 | 11/1939 | Parrish | 285/146 |
| 2,244,393 | 6/1941 | Haas | 181/243 |
| 2,382,159 | 8/1945 | Klemm | 181/241 |
| 2,476,656 | 7/1949 | Galbraith | 285/146 |
| 2,669,469 | 2/1954 | Finch | 285/158 |
| 2,673,751 | 3/1954 | Finch | 285/175 |
| 2,727,536 | 12/1955 | Tennison . | |
| 2,779,498 | 1/1957 | Cole et al. | 285/158 X |
| 2,936,184 | 5/1960 | Epstein | 285/81 |
| 2,943,695 | 7/1960 | Jeffords | 181/243 |
| 2,959,196 | 11/1960 | Truesdell et al. . | |
| 3,066,959 | 12/1962 | White | 285/81 |
| 3,233,923 | 2/1966 | Raider et al. | 285/239 |
| 3,233,927 | 2/1966 | Dewhirst | 285/401 |
| 3,386,529 | 6/1968 | Pannone | 181/243 |
| 3,388,935 | 6/1968 | Hjalsten et al. | 285/334 X |
| 3,581,842 | 6/1971 | Hall | 181/243 |
| 3,813,115 | 5/1974 | French | 285/92 |
| 4,050,721 | 9/1977 | Streit | 285/93 |
| 4,140,422 | 2/1979 | Crumpler, Jr. et al. | 285/401 X |
| 4,174,858 | 11/1979 | Brooks | 285/390 X |

*Primary Examiner*—Benjamin R. Fuller

*Attorney, Agent, or Firm*—Anthony J. Casella; Gerald E. Hespos

[57] ABSTRACT

A technique for threadedly securing muffler nipples to a muffler body is disclosed. The muffler nipples are provided with a threaded portion which is adapted to be inserted into a bushing attached to the muffler body, threadedly secured thereto, and tightened with a predetermined torque designed to prevent the nipples from unthreading or loosening within the muffler body.

26 Claims, 11 Drawing Figures

THREADED MUFFLER NIPPLE AND BUSHING

BACKGROUND OF THE INVENTION

The present invention is directed to the field of replacement mufflers, and more specifically to the field of replacement mufflers which can be used to replace original equipment mufflers without requiring any substantial modifications thereto.

It is well known that automotive exhaust systems, and in particular mufflers, are subject to a great deal of physical and thermal stress, and as a result must often be replaced. Indeed, the muffler replacement industry is quite large.

It has been the practice of the larger muffler replacement companies to stock a full line of replacement mufflers which are substantially identical to the original equipment mufflers. By doing so, the original muffler may typically be replaced by separating the tubes or "nipples" on both sides of the muffler from the exhaust and tail pipes, and by reattaching a substantially equivalent structure to the respective pipes. In some cases however, the downstream nipple is not attached to a separate tail pipe, the downstream nipple itself forming the tailpipe or spout. In such case the original muffler is replaced by separating the upstream nipple from the exhaust pipe and by reattaching the substantially equivalent structure thereto. In either case, the resulting exhaust system is essentially a duplicate of the original system. As used throughout the specification and claims, the term "nipple" will be deemed to include the tubes on both sides of the muffler, whether they are attached to exhaust or tail pipes, or whether they form an exhaust pipe or spout without further connection to an external pipe.

Although the above described technique is relatively simple to accomplish, it is expensive since it is necessary to produce and stock from 600 to 800 different kinds of mufflers in order to substantially duplicate the original equipment mufflers for the various makes and models of domestic and foreign automobiles. Further, the storage and inventory requirements are indeed prohibitive for all but the largest replacement muffler manufacturers and installers. Still further, since each type of muffler must be made from scratch and requires a significant retooling of the assemble line, a long lead time is many times required when ordering a particular muffler.

A technique for avoiding the problems associated with the above described procedure employed the use of a "universal" muffler which could be used to replace the original equipment on a wide range of vehicles, thus reducing the inventory and storage requirements associated with the above described procedure. One such universal muffler employed a muffler body having an adjustable length, as disclosed in U.S. Pat. No. 2,382,159 to Klemm. Another type of universal muffler employed the use of nipples which were slidably disposed within the muffler body to effect different length connections between the exhaust and tail pipes. An example of such a system is disclosed in U.S. Pat. No. 3,581,842 to Hall.

Still other types of universal mufflers employed nipples produced from drawing quality aluminum killed steel, at least one of which was produced with a longer than average length. The muffler would be placed between the exhaust pipe and the tail pipe and if the distance between the two were significantly less than the nipple-to-nipple length of the muffler, the extended length nipple could be trimmed so as to allow the muffler to fit between the exhaust and tail pipes. Further, if it were found that the diameters of the exhaust and tail pipes were too large for the nipples provided on the mufflers, the nipples could be open up to a wider diameter by swaging or otherwise expanding. Examples of such mufflers are disclosed in U.S. Pat. No. 4,164,267, dated Aug. 14, 1979 to Meineke et al., which has since been dedicated to the public, U.S. Pat. No. 4,279,326 dated July 21, 1981, also to Meineke et al., and in the American Muffler Corporation Exhaust Parts Catalog cited in U.S. Pat. No. 4,279,326.

Although the "universal" mufflers can be used on a wide range of automobiles, each type of universal muffler described above has its drawbacks. For example, the universal muffler having the adjustable length muffler body is rather complex, expensive to manufacture, and limited in internal configuration. The universal mufflers having the aluminum killed steel nipples require a considerable amount of time to install and the replacement is not as aesthetically acceptable as that associated with the "made-to-fit" replacement. Further, the use of the universal mufflers having the aluminum killed steel nipples requires specialized apparatus, such as a swaging tool for increasing the nipple diameters if necessary.

OBJECTS AND SUMMARY OF THE INVENTION

It is therefore an object of the invention to provide a technique which overcomes the shortcomings associated with the prior art mufflers.

It is a further object of the invention to provide muffler nipples which can be threadedly secured to a muffler body.

It is a further object of the invention to provide a muffler bushing which is attached to a muffler body and which allows a muffler nipple to be threadedly attached thereto.

It is a further object to provide a method for threadedly securing a muffler nipple to a muffler body.

In accordance with the first aspect of the invention, a muffler nipple adapted to be threadedly secured to a bushing connected to a muffler body includes a nipple portion, a threaded portion, and a shank. The nipple portion is adapted to be disposed outside of the muffler body when the muffler nipple is secured to the bushing. The threaded portion is connected to the nipple portion and is adapted to threadedly engage the bushing by rotating the muffler nipple through an axis of rotation. The threaded portion includes a continuous helical thread. The shank portion is disposed between the nipple portion and the threaded portion and is adapted to abut and impart an axial force on the muffler body proximate to the bushing when secured thereto.

More specifically, the continuous helical thread is adapted to produce a loosening-to-tightening torque ratio of at least approximately 60%. The nipple portion is preferably joined to the shank portion by an interface adapted to prevent at least some movement imparted to the nipple portion from propagating to the shank portion. Preferably, the interface comprises an annular radius circumferentially formed at the interface of the shank and nipple portions. A pair of diametrically opposed holes or notches may optionally be provided in the nipple portion to facilitate installation.

More specifically, the helical thread may be disposed at an approximate helix angle $\psi$ relative to a plane perpendicular to the axis of rotation. The thread has at least one side wall generally angled at an approximate thread angle $\alpha$ relative to the perpendicular plane. The helix angle $\psi$ and thread angle $\alpha$ allow the muffler nipple to be threadedly secured to the bushing with an approximate tightening torque of at least 40 ft. lbf. Further, the shank portion may be disposed at an angle $\theta$ relative to the axis of rotation, the angle $\theta$ allowing the muffler nipple to be secured to the bushing with a suitable axial force. The helix angle $\psi$ is preferably between approximately 1° and 20°, the thread angle $\theta$ is preferably less than approximately 60°, and the angle $\theta$ is preferably at least 25°. Further, the helical thread preferably winds around the threaded portion for at least one revolution.

In accordance with a second aspect of the invention, a muffler bushing adapted to be connected to a muffler body includes a threaded portion and a connector portion. The threaded portion is adapted to threadedly engage a muffler nipple by rotation of the muffler nipple through an axis of rotation. The threaded portion includes a continuous helical thread. The connector portion is connected to the threaded portion and is adapted to be connected to the muffler body such that a portion of the muffler nipple abuts and imparts an axial force on the connector portion when the muffler nipple is secured to the muffler bushing.

Specifically, the continuous helical thread can produce a loosening-to-tightening torque ratio of at least approximately 60% in a manner similar to that provided for the muffler nipple, the helical thread on the muffler bushing being disposed at an approximate helix angle $\psi$ relative to a plane perpendicular to the axis of rotation, the thread having at least one side wall generally angled at an approximate thread angle $\alpha$ relative to the perpendicular plane. The helix angle $\psi$ and thread angle $\alpha$ of the bushing thread allow the muffler bushing to threadedly secure the nipple with an approximate tightening torque of at least 40 ft. lbf. and with a suitable axial force. Preferably, the helix angle of the muffler nipple thread is approximately one-half a degree smaller than the helix of the bushing thread and the muffler nipple thread angle is approximately 10° smaller than the thread angle of the muffler bushing. Ideally, the bushing threads will slightly deform under the force of the nipple threads. To this end, the muffler nipple and the muffler bushing may be made from a metal material, the metal material of the nipple being approximately 0.02 to 0.03 inches thicker than the metal material in the bushing. Further, the outer major thread diameter of the muffler nipple may be slightly greater than the inner major thread diameter of the muffler bushing to thereby further increase the interference fit between the nipple and bushing.

In accordance with a third aspect of the invention, a process for producing a muffler having a preselected muffler body and at least one preselected muffler nipple extending from the muffler includes the steps of selecting one of a plurality of differing muffler bodies having at least one threaded bushing therein, selecting a first threaded muffler nipple from a plurality of differing threaded muffler nipples, inserting the first muffler nipple into the threaded bushing, rotating the first muffler nipple in the threaded bushing so as to threadedly engage the first muffler nipple in the bushing, and tightening the first muffler nipple in the bushing.

The process may further include the step of applying an adhesive to at least one of the first muffler nipple and the muffler bushing. Preferably, the first muffler nipple is tightened in the muffler bushing with a torque of at least 40 ft. lbf.

The process may further include the steps of selecting a second threaded muffler nipple from the plurality of differing threaded muffler nipples, inserting the second muffler nipple into a second threaded bushing in the muffler body, rotating the second muffler nipple in the second bushing so as to threadedly engage the second muffler nipple in the second bushing, and tightening the second muffler nipple in the second bushing.

In accordance with a fourth and final aspect of the present invention, a replacement muffler kit includes a muffler body having at least one threaded bushing connected to an end of the muffler body, and at least one threaded nipple adapted to be threadedly secured to the bushing to thereby produce a complete replacement muffler.

BRIEF DESCRIPTION OF THE DRAWINGS

These and other objects and aspects of the invention will be described in more detail with reference to the following drawing figures of which.

DETAILED DESCRIPTION OF THE INVENTION

Figure 1A:
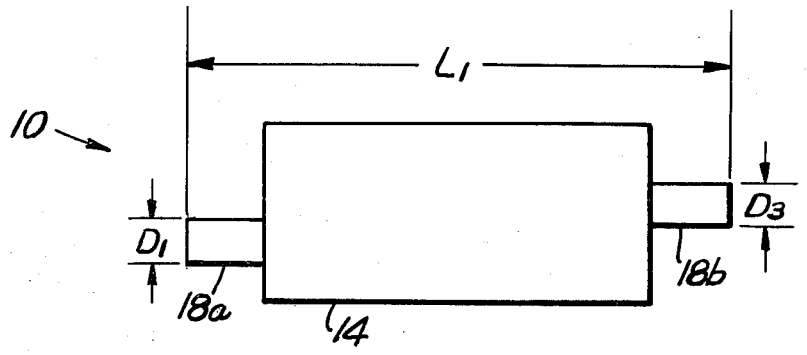
FIG. 1 is a plan view illustrating a pair of replacement mufflers having different nipple-to-nipple lengths and diameters, both of which may be made from the same muffler body in accordance with the present invention.
Figure 1B:
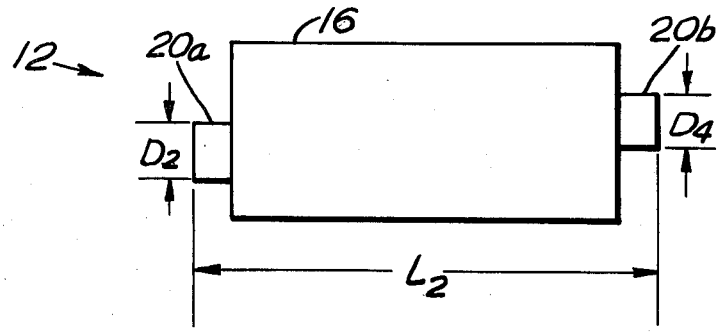

FIGS. 1A and 1B illustrate a pair of mufflers 10 and 12 having essentially identical muffler bodies 14 and 16, respectively, and respective pairs of muffler nipples **18*a*/18*b* and 20*a*/20*b* in accordance with the present invention. Muffler 10, provided with muffler nipples 18*a* and 18*b* is adapted to replace an original equipment muffler having a nipple-to-nipple distance $L_1$ and nipple diameters $D_1$ and $D_3$, while muffler 12, provided with nipples 20*a* and 20*b* which are shorter and of greater diameter than nipples 18*a* and 18*b***, is adapted to replace an original equipment muffler having a nipple-to-nipple distance of approximately $L_2$ and nipple diameters $D_2$ and $D_4$.

Those skilled in the art will appreciate that if the nipple pairs 18*a*/18*b* and 20*a*/20*b* could be secured to the muffler bodies 14 or 16 at the time of installation, great savings in inventory requirements and cost can be achieved. Since muffler bodies 14 and 16 can be used interchangeably with different sets of muffler nipples many different types of replacement mufflers can be produced from the same muffler body, and may thus be used to replace a wide range of original equipment mufflers. More specifically, the muffler installer who would otherwise stock either exact duplicates of the original equipment mufflers, which would require an inventory of 600 to 800 different types of mufflers, or the universal mufflers which require the special nipple swaging and trimming operations, would be able to stock a relatively small number of different types of muffler bodies and a full line of threaded muffler nipples which would allow the muffler bodies to be "customized" to replace virtually any original equipment muffler by providing the appropriate nipple-to-nipple distance and nipple diameters. Stated differently, by stocking 60 to 80 different types of basic muffler bodies, a full line of 600 to 800 different types of replacement mufflers could be produced, assuming that each of the 60 to 80 body styles could be fit with approximately 10 different sets of muffler nipples.

Due to the size and expense of producing an individual muffler body, compared to the size and expense of producing muffler nipples, it will be appreciated that a muffler installer could greatly increase his operating efficiency by stocking relatively few different types of muffler bodies and a larger number of customized muffler nipple sets. Since the nipple portions of the muffler are smaller and more cheaply and readily produced, a large number of the different types of nipples may be easily stored and readily manufactured upon demand.

The manner in which the muffler nipples are secured to the muffler body will be briefly discussed with reference to FIG. 2. The muffler 10 can be produced by securing muffler nipple 18*a* to muffler body 14 at muffler bushing 22 which in turn is secured to muffler head 24 at the end of the muffler body 14 by means of bead 48. The muffler can be completed by attaching muffler nipple 18*b* to the other muffler head (not shown) at the other side of the muffler body 14.

In accordance with a fundamental principle of the present invention, the muffler 12, rather than muffler 10, can alternatively be produced by using the same muffler body (in this case designated as muffler body 16) by securing to the bushing 22 muffler nipple 20*a* having a different nipple length and nipple diameter $D_2$, and by accordingly securing the right hand nipple 20*b* to the other side of the muffler body.

The muffler nipple 18*a* (or 20*a*) in accordance with the present invention will be described in more detail with reference to FIG. 3. Illustrated therein is a nipple portion 26 having an outer nipple radius $r_n$, and a threaded portion 28 joined to the nipple portion at shank portion 30. A pair of holes 31*a* and 31*b*, notches (not shown), or any other expedient, may optionally be provided on diametrically opposed sides of nipple portion 26 to facilitate the tightening of the nipple as will be described below. Each of the nipple, shank and threaded portions 26, 30 and 28, respectively, are generally cylindrical in shape and co-axially disposed about an axis of rotation 32. Threaded portion 28 is provided with a continuous helical thread 34 which is disposed at a helix angle $\psi_1$ relative to a plane perpendicular to the axis of rotation 32. The side walls of the thread 34 are each disposed at thread angle $\alpha_1$ relative to the plane perpendicular to the axis of rotation 32, thus providing a double thread angle between the thread walls of $2\alpha_1$. In accordance with the preferred embodiment, the continuous helical thread 34 makes approximately two revolutions of the threaded portion 28. The thread 34 is provided with a pitch p and outer major thread radius $r_2$ measured from the axis of rotation 32 to the peak of the thread. The base portion 36 of threaded portion 28 is provided with an outer minor thread radius $r_1$ relative to the axis of rotation 32.

The shank portion 30 is defined by an annular section of a cone having an inclined angle $\theta$ relative to the axis of rotation 32. Nipple portion 26 intersects shank portion 30 at an interface formed by an annular radius 38 formed at the intersection, as better illustrated in FIG. 5.

Figure 2:
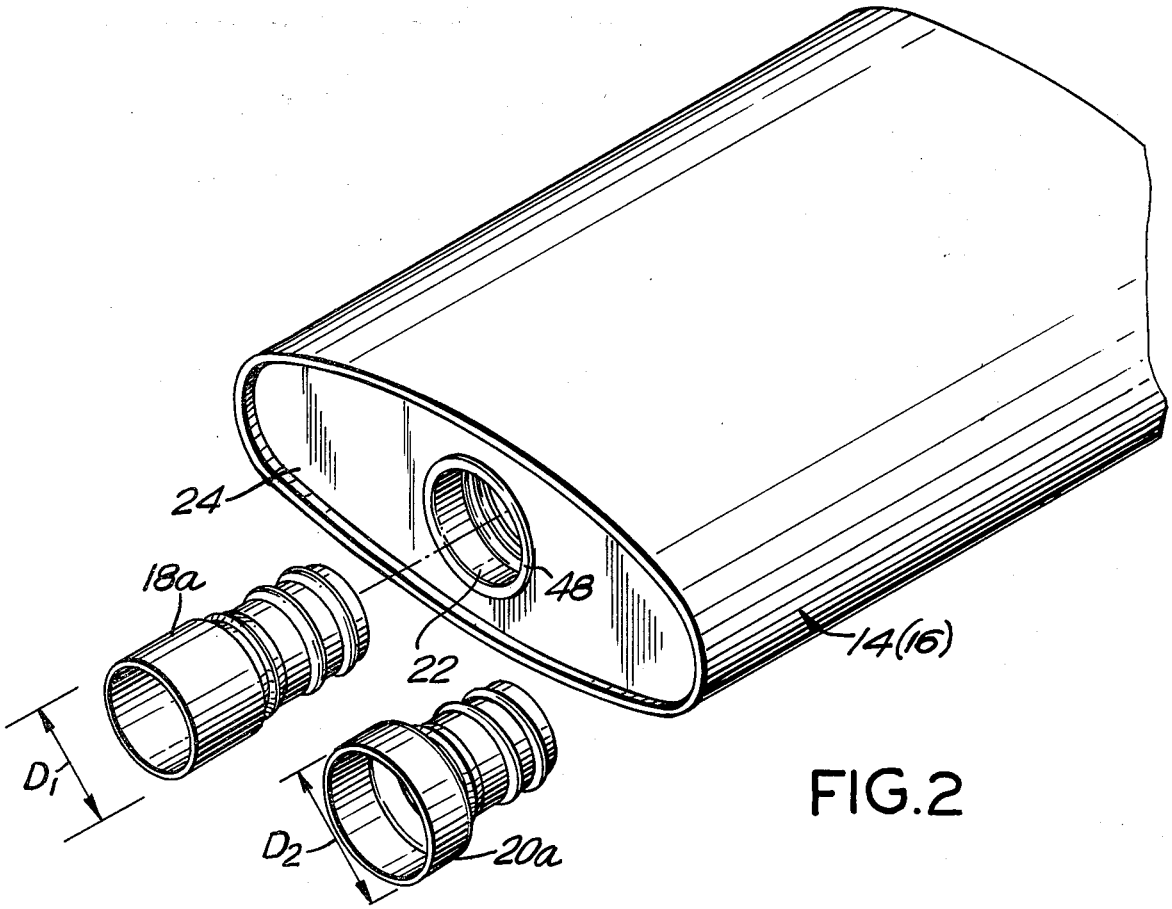
FIG. 2 is a perspective view of the muffler body having a threaded muffler bushing and the threaded muffler nipple which is adapted to be threadedly secured to the muffler body in accordance with the present invention.

It will be appreciated that nipple 20*a* is essentially identical to nipple 18*a* except for nipple portion 26 which will have the length and diameter as generally illustrated in FIGS. 1*b* or 2.

The details of bushing 22 will now be discussed with reference to FIG. 4. The bushing is comprised of connector portion 40 and threaded portion 42 connected to the connector portion 40. Connector portion 40 and threaded portion 42 are both generally cylindrical and co-axially disposed about the axis of rotation 32' corresponding to the axis of rotation 32 of the threaded nipple when the nipple is disposed within the bushing 22. Bushing 22 is disposed almost exclusively within the interior of the muffler body 14 and is connected at the end of connector portion 40 to an aperture 44 provided in the muffler head 24. The bead 48 is produced by the connection between the bushing and the muffler head. The connection between the muffler bushing 22 and the muffler head 24 is better illustrated in FIG. 5.

Included on threaded portion 42 is a continuous helical thread 34' adapted to mate with nipple thread 34. Thread 34' is disposed about the base 46 of the threaded portion 42 at a helix angle $\psi_2$ relative to a plane perpendicular to the axis of rotation 32'. The side walls of the thread 34' are each disposed at a thread angle $\alpha_2$ relative to the plane perpendicular to the axis of rotation 32' to thus produce a double thread angle $2\alpha_2$ between the side walls of the thread. Although not shown, the major and minor thread radii are defined for the bushing thread in a manner similar to that for the nipple thread.

Figure 4:
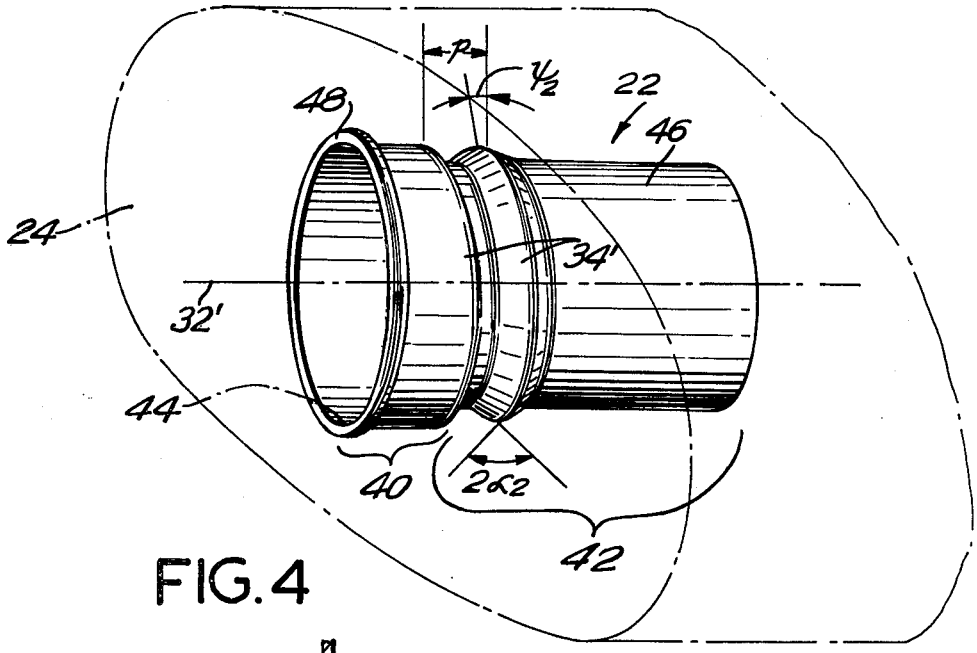
FIG. 4 is a perspective view illustrating the details of the threaded muffler bushing in accordance with the present invention.
Figure 5:
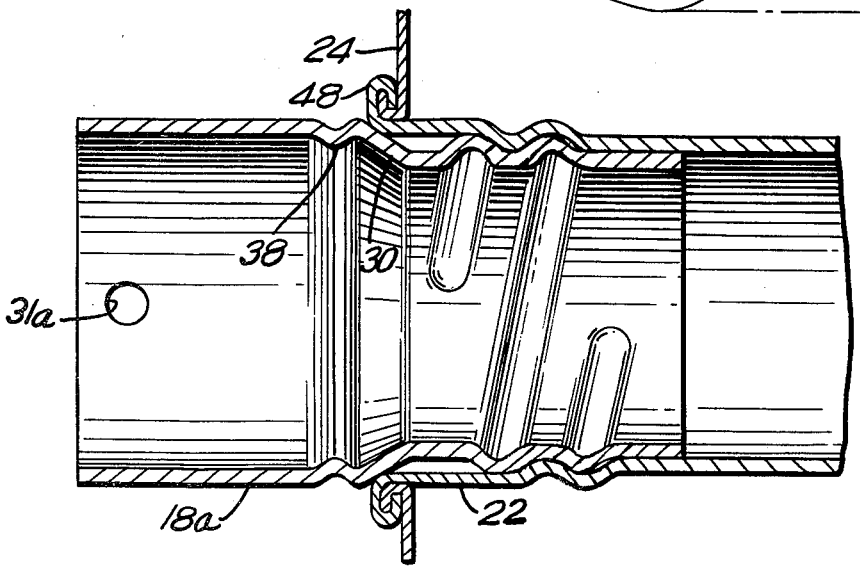
FIG. 5 is a cross-sectional view of the threaded muffler nipple disposed within the threaded muffler bushing in accordance with the present invention.

In operation the muffler nipple 18*a* is adapted to be threadedly engaged by the muffler bushing 22 as generally illustrated in FIG. 5. If desired, the pair of through holes 31*a* and 31*b*, or other means, could be provided in the nipple through which a screwdriver or other similar tool could be inserted to facilitate the tightening of the nipple into the bushing. As shown in FIG. 5, the connector portion of bushing 22 is connected to head 24 at the aperture 44 (FIG. 4). The juncture between the bushing, 22 and the head 24 forms the annular bead 48 against which the shank portion 30 abuts when the nipple is secured to the bushing. The mating relationship between the thread 34 on the muffler nipple and the thread 34' on the bushing is clearly illustrated in the figure.

Use of the threaded nipple and bushing to produce a replacement muffler in accordance with the present invention strictly requires that the nipple will not become unthreaded or otherwise loosen within the bushing. Such parameters as helix angles $\psi_1$, $\psi_2$, thread angles $\alpha_1$, $\alpha_2$, the shank angle $\theta$, nipple radii $r_1$ and $r_2$, as well as the relative thicknesses of the nipple and bushing materials, may be selected to insure that such unthreading or loosening will not occur.

It has been found that the average muffler is subjected to a wideband force spectrum from approximately 15 to 60 Hz of approximately 40 to 60 ft. lbf. total cyclic torque. Working with 40 to 60 ft. lbf. as the typical maximum cyclic torque range, a tightening torque requirement can be developed. Since the loosening torque of a threaded fastener is less than the tightening torque, the difference or ratio must be determined in order to specify the tightening torque.

It is known that the loosening, or removal torque $T_R$ is related to the axial force or preload P produced by the shank bearing upon the annular bead 48, by the equation:

$$T_R = \left[ \frac{\mu_c d_s}{2\sin\theta} + \frac{d_t}{2}\left[ \frac{\mu\cos\psi - \cos\alpha\sin\psi}{\mu\sin\psi + \cos\alpha\cos\psi} \right] \right] P. \quad (1)$$

The preload P is related to the tightening torque $T_{tight}$ by $$P = \frac{T_{tight}}{\frac{\mu_c d_s}{2\sin\theta} + \frac{d_t}{2}\left[ \frac{\cos\alpha\sin\psi + \mu\cos\psi}{\cos\alpha\cos\psi - \mu\sin\psi} \right]}, \quad (2)$$

thus relating the loosening torque $T_R$ to the tightening torque $T_{tight\ by}$ $$T_R = \left[ \frac{\frac{\mu_c d_s}{2\sin\theta} + \frac{d_t}{2}\left[ \frac{\mu\cos\psi - \cos\alpha\sin\psi}{\mu\sin\psi + \cos\alpha\cos\psi} \right]}{\frac{\mu_c d_s}{2\sin\theta} + \frac{d_t}{2}\left[ \frac{\cos\alpha\sin\psi + \mu\cos\psi}{\cos\alpha\cos\psi - \mu\sin\psi} \right]} \right] T_{tight}, \quad (3)$$

where $P$ = preload (lbf.)
$T_{tight}$ = tightening torque (In. lbf.),
$d_s = 2r_s$ = shank mean diameter (In.) = $r_n + r_1$,
$d_t = 2r_t$ = thread mean diameter (In.) = $r_1 + r_2$,
$\mu_c$ = coefficient of friction between the nipple shank incline and bead,
$\mu$ = coefficient of friction between the nipple and bushing threads,
$\theta$ = shank angle,
$\psi = \psi_1 = \psi_2$ = helix angle of the threads,
$2\alpha = 2\alpha_1 = 2\alpha_2$ = thread angle,
$T_R$ = loosening or removal torque (In. lbf.),
$d_n = 2r_n$ = nipple outside diameter (In.),
$r_1$ = outside minor thread radius (In.), and
$r_2$ = outside major thread radius (In.).

Figure 6:
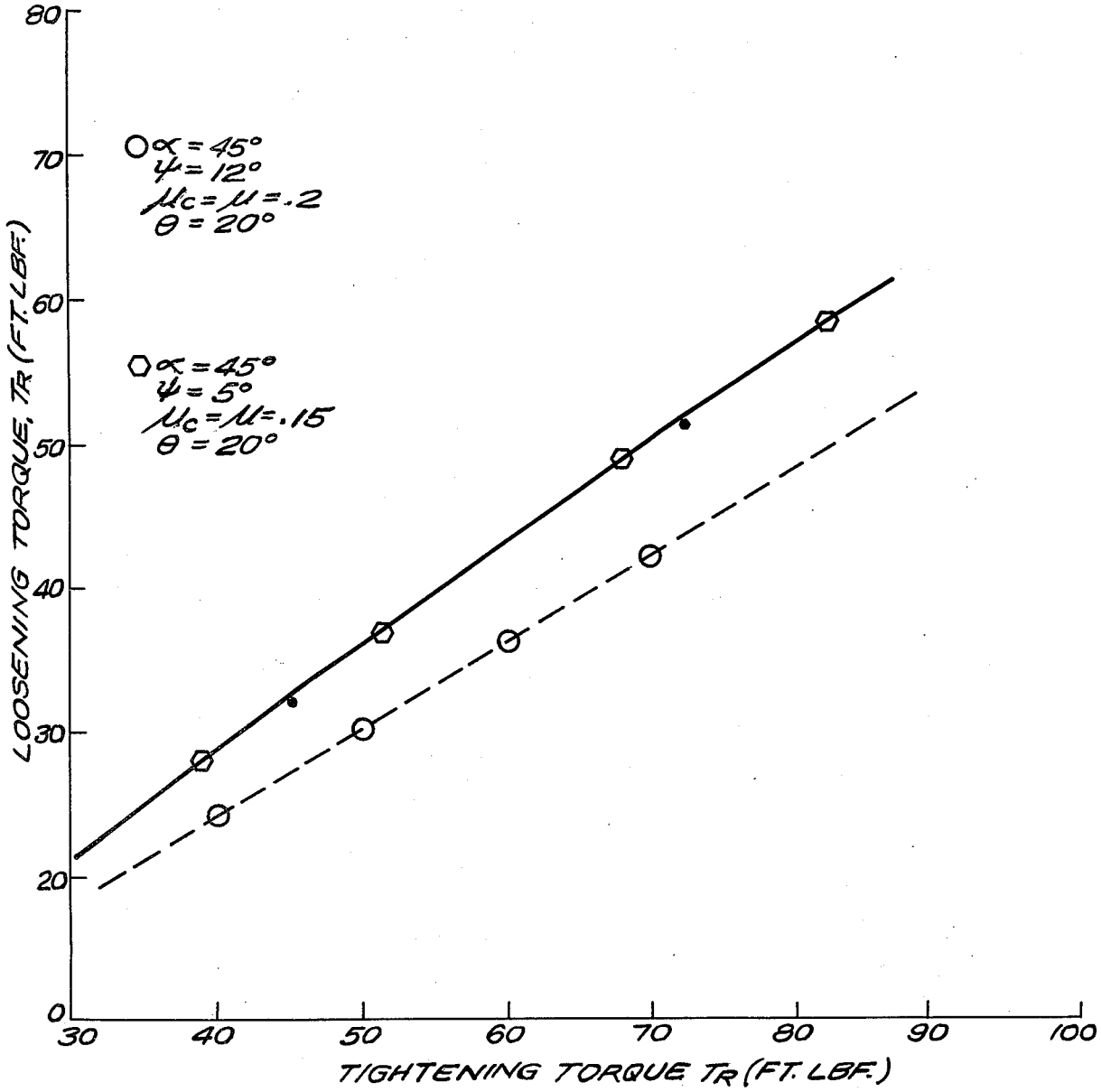
FIG. 6 is a graph illustrating the variation of loosening torque of the threaded muffler nipple within the threaded muffler bushing as a function of tightening torque.

With reference to FIG. 6, a pair of plots are shown illustrating the relationship between tightening and loosening torque for two different sets of parameters. It can be seen that by decreasing the thread angle $\psi$ from 12° to 5°, the loosening-to-tightening torque ratio may be increased from approximately 60% to approximately 72%. Therefore, the helix angles $\psi_1$ and $\psi_2$ for the nipple thread 34 and the bushing thread 34' are preferably chosen to be approximately 5° for the nipple thread 34 and approximately 5½° for the bushing. The ½° difference between the nipple and bushing threads produces a tight interference fit between the threads. Thus, a loosening torque $T_R$ of approximately 40 ft. lbf. can be achieved by providing a tightening torque of about 55 ft. lbf. Additionally, the radius 38 provided between the nipple and shank portions acts to prevent a portion of the torques imparted to the nipple from propagating to the shank, resulting in even higher effective loosening-to-tightening torque ratios. For some applications, however, it is envisioned that radius be omitted as long as a suitable loosening-to-tightening torque ratio is developed by the threads alone.

Even further increases in the loosening-to-tightening torque ratio may be achieved by making the outer major thread diameter of the nipple slightly greater (i.e. on the order of 0.001") than the inner major thread diameter of the bushing, or by using a suitable temperature stable adhesive between the nipple and bushing threads during assembly. As will be appreciated by those skilled in the art, the use of these techniques will depend upon a determination of the desired loosening-to-tightening torque ratios, the available tightening torques and the expected loosening torques.

Figure 7:
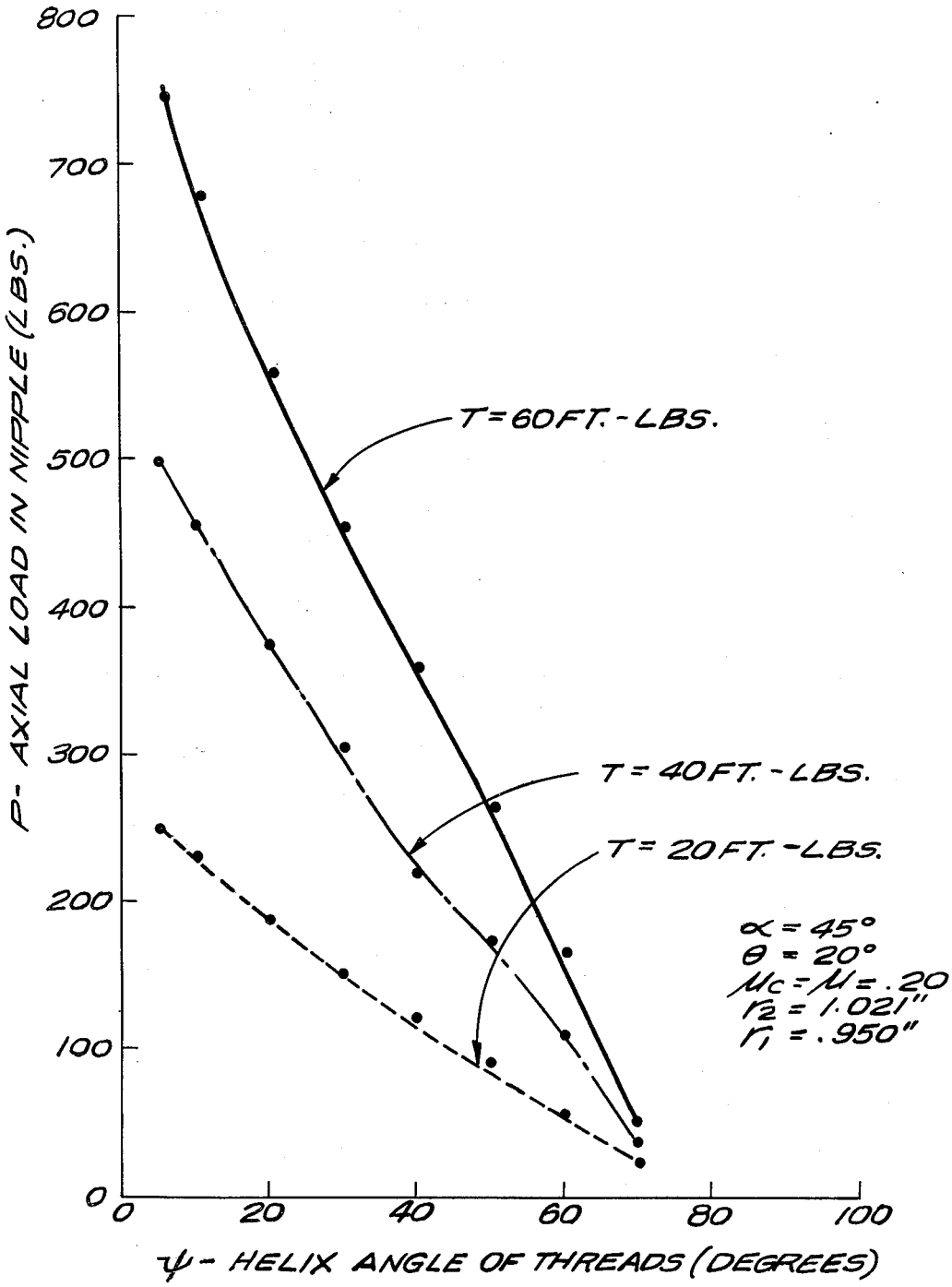
FIG. 7 is a graph illustrating the variation of axial load on the nipple as a function of the helix angle of the nipple and bushing threads.

FIG. 7 is a graph which illustrates the axial force or preload P as a function of helix angle $\psi$ for three tightening torques T. Since a high preload P produces a high removal torque $T_R$ (Equation 1), and since the preload P is inversely proportional to the helix angle $\psi$, the choice of a 5° helix angle produces a desirably high axial preload P. Based on a tightening torque of at least approximately 55 ft. lbf., which in turn is based on the expected loosening torques and the relationship between tightening and loosening torque as shown in FIG. 6, it is apparent that an axial preload P of at least 500 lbf. will be experienced.

Figure 8:
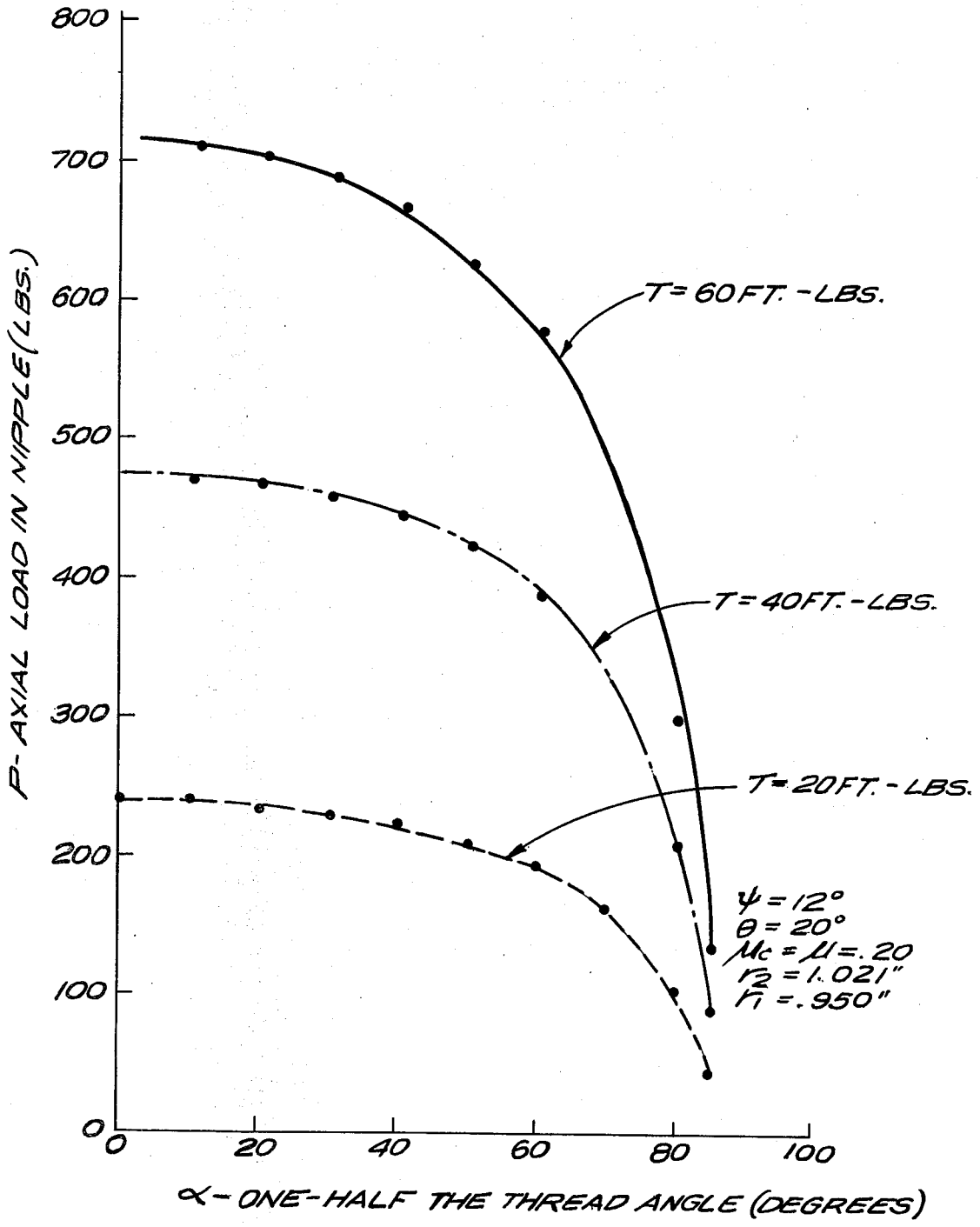
FIG. 8 is a graph illustrating the variation of the axial load on the nipple as a function of one-half the thread angle for the nipple and bushing.

Similar results obtain from the graph illustrated in FIG. 8 which compares the axial preload P to the one-half thread angle, $\alpha$, where for a thread angle $\alpha$ of 45°, the minimum expected preload would be on the order of 500 lbf. using a tightening torque of about 55 ft. lbf.

Although Equations 1–3 are given for a single thread angle $\alpha$, it has been found that when fabricating the nipple and bushing in accordance with the present invention it is desirable to increase the thread angle $\alpha_2$ for the bushing approximately 10° relative to the thread angle for the nipple. Thus, in accordance with the example illustrated in FIGS. 3 and 4, the thread angle $\alpha_1$ for the nipple thread 34 is approximately 45°, while the thread angle $\alpha_2$ for the bushing thread 34' is approximately 55°.

Since at least approximately 55 ft. lbf. in tightening torque will be employed thus producing at least 500 lbf. in axial preload P, it is necessary to provide continuous threads 34 and 34' which make approximately two full revolutions of the nipple and bushing, respectively. The continuous threads provide a uniform thread stress distribution and an essentially gas tight connection while reducing the chances of failure by creep. The continuous threads also provide lower temperature gradients between the nipple and bushing thereby reducing the possibility of loosening due to differential thermal expansion between the nipple and the bushing. Further, the continuous threads ensure bushing to nipple thread engagement, allow wide thread tolerances, and allow for a significant amount of nipple over-tightening.

In order to prevent excessive strain on the nipple because of high preloads on the order to 500 to 700 lbf., the nipple material is preferably set to a minimum of approximately 0.06 inches in thickness. Since it is desirable that the bushing threads 34' slightly deform or yield to the pressure exerted on them by the nipple threads 34 to ensure uniform thread stresses, a thickness for the bushing slightly less than the thickness of the nipple material is desired. In the above example, a 0.042 inch thick material is preferably employed for the bushing. Both the nipple and bushing may be made of commonly used material such as 1010 C.R.S. Alternatively, the bushing thread geometry, rather than material thickness, may be altered to insure that bushing threads 34' will yield under the force exerted by the nipple threads.

Figure 9:
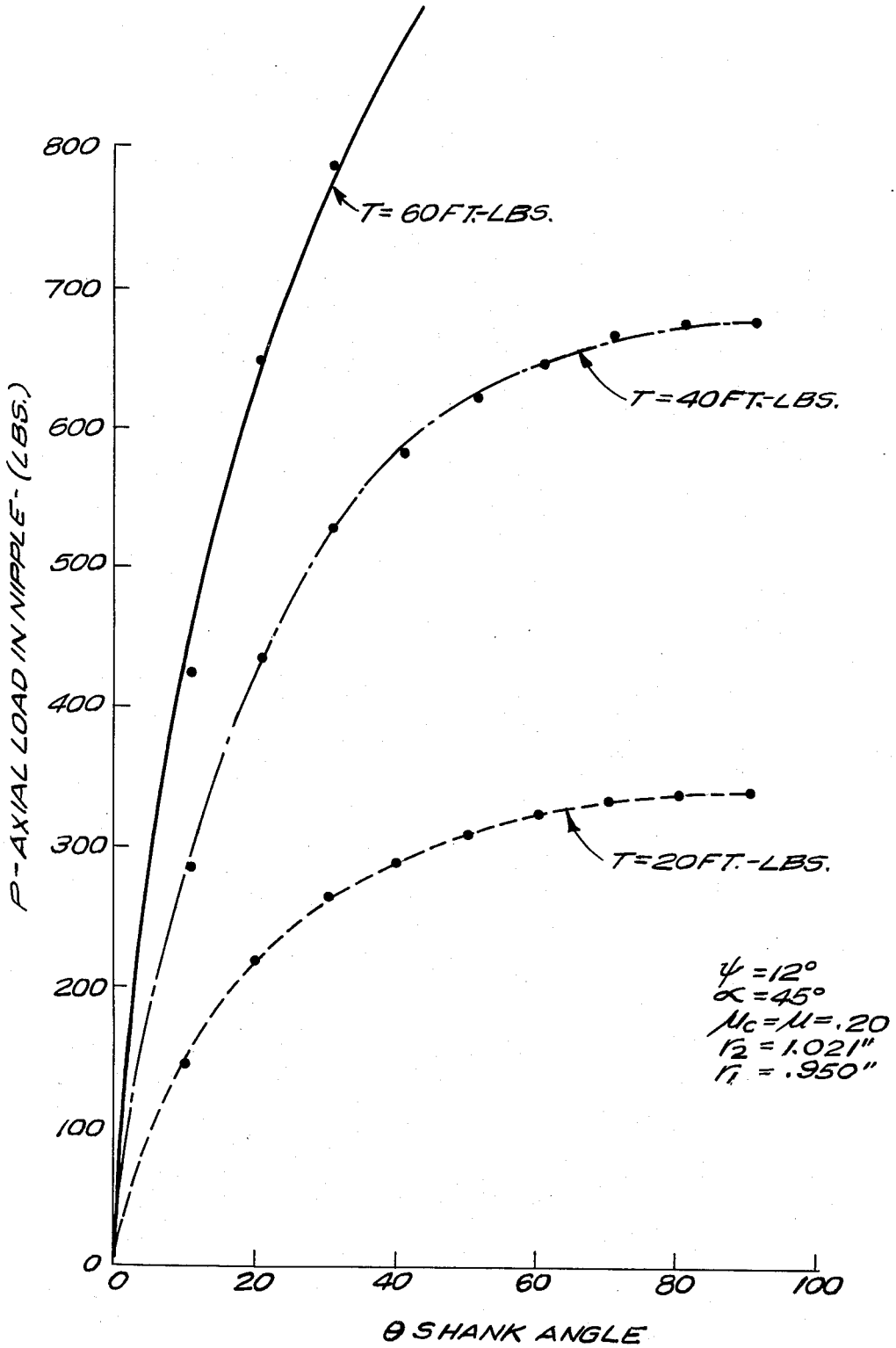
FIG. 9 is a graph illustrating the variation of the axial load on the nipple as a function the shank angle of the nipple.

FIG. 9 illustrates the axial preload P as a function of shank angle $\theta$ for three different tightening torques T. Although a shank angle of 90° is theoretically desirable, a more practical shank angle has been found to be approximately 30°. The 30° shank angle $\theta$ allows the desired preloads to be easily achieved.

Figure 10:
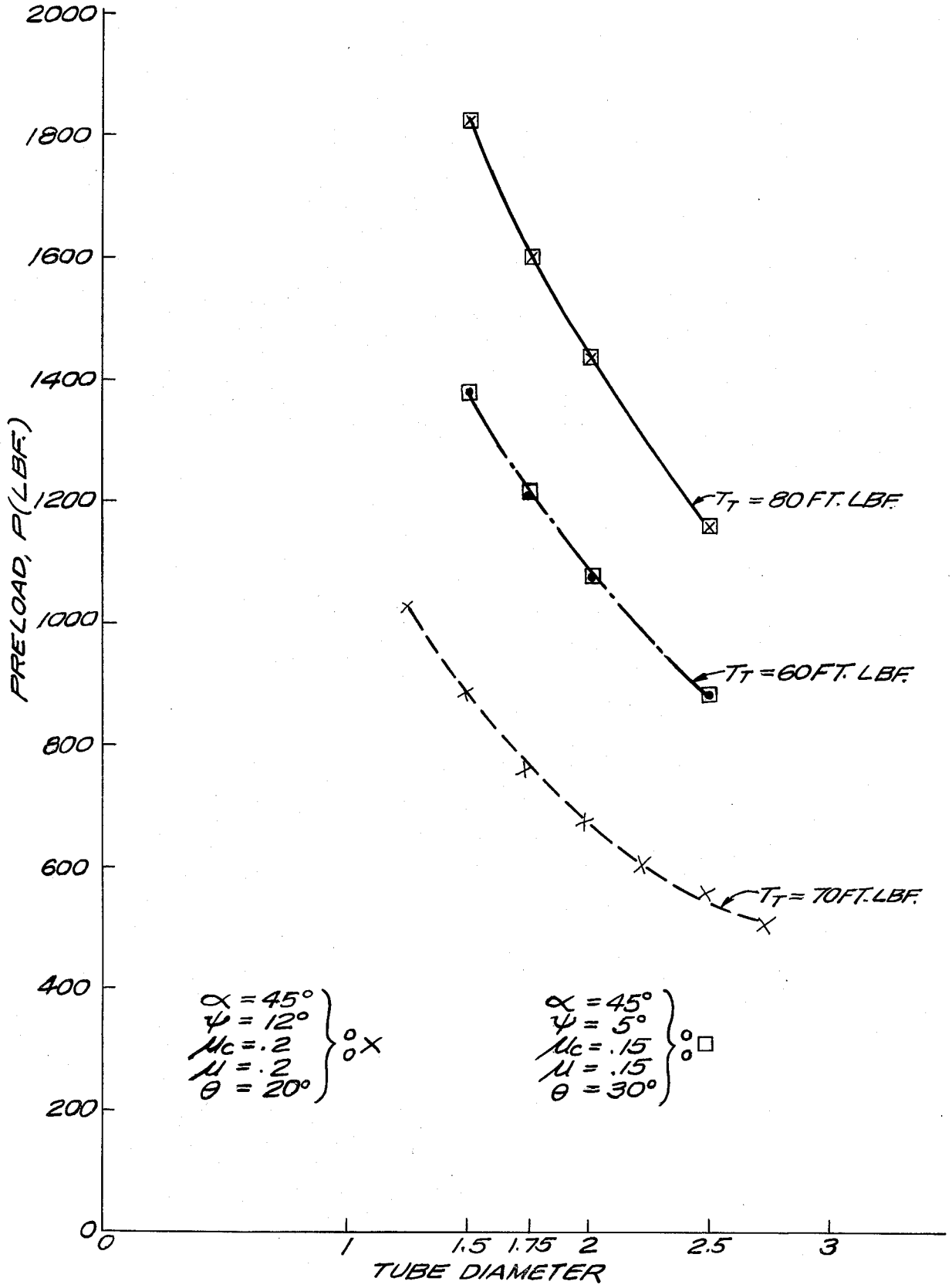
FIG. 10 is a graph illustrating the variation of the axial load on the nipple as a function of nipple diameter.

Finally, FIG. 10 illustrates preload P as a function of nipple diameter for three tightening torques T and for two different sets of parameters $\alpha$, $\mu_c$, $\mu$ and $\theta$. With the tube diameter of approximately 2 inches it can be seen that the desired preload can also easily be achieved.

The correct positioning and proper torque can, if desired, be accomplished by aligning properly located scribe marks (not shown) on the nipple and bushing as the nipple is torqued on.

Figure 3:
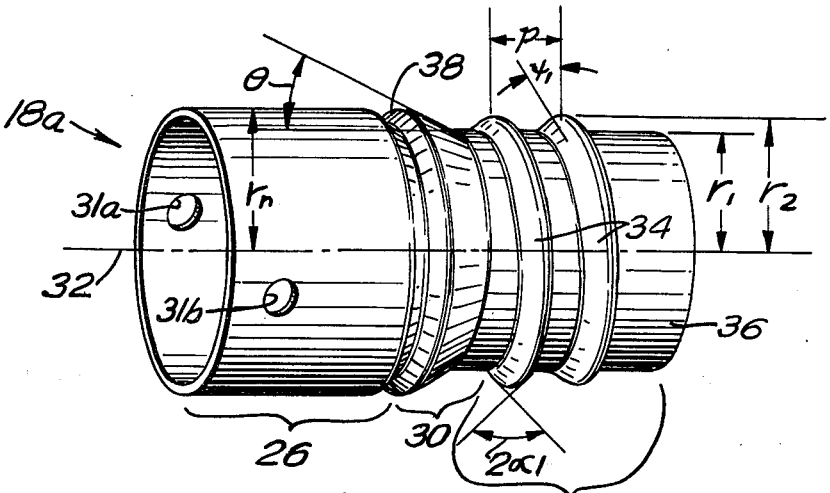
FIG. 3 is a perspective view illustrating the details of the threaded muffler nipple in accordance with the present invention.

In accordance with the example illustrated in FIGS. 3, 4 and 5, the helix angles $\psi_1$ and $\psi_2$ were selected to be approximately 5° and $5\frac{1}{2}$°, respectively, and the thread angles $\alpha_1$ and $\alpha_2$ were selected to be approximately 45° and 55°, respectively. The thread pitch p was selected to be approximately 0.55 inches. The radius of the base $r_1$ was selected to be approximately 0.950 inches, while the radius $r_2$ of the thread 34 was selected to be approximately 1.021 inches. The thicknesses of the nipple and bushing materials were selected to be approximately 0.060 inches and 0.042 inches, respectively, thus insuring a certain degree of deformation of the bushing threads with a sufficient tightening torque. Finally, the shank angle $\theta$ of 30° was also selected.

The nipple and bushing produced in accordance with the above example have provided a torque of at least 150 ft. lbf. and can probably achieve a much higher torque, although this would not be necessary. At the 150 ft. lbf. torque, the nipple would not come loose from the bushing with a conventional torque wrench without heating and then applying a loosening torque of 120 ft. lbf., representing an 80% loosening-to-tightening torque ratio, even higher than that expected from FIG. 6. The reason for the high loosening torque was not precisely determined, but it is suspected that the bushing yielded, the inner diameter of the bushing becoming smaller thus creating a high frictional force on the nipple.

It has also been found that if the bushing is not tightly connected to the head 24, the bushing may tend to rotate with the nipple upon tightening. If such is the case, it may be necessary to spot weld the bushing to the head or some internal part of the muffler, or to otherwise insure a highly secure and tight connection between the bushing and the head.

Thus, the present invention provides a technique for threadedly securing a muffler nipple to a bushing connected to a muffler body. When used in this manner, the present invention allows a wide variety of replacement mufflers to be made from a relatively smaller number of muffler bodies, thus increasing the operating efficiency and reducing the inventory requirements of replacement muffler shops. However, the present invention readily lends itself to use in retail auto parts stores where the selected muffler body and nipples could be sold to the user in "do it yourself" kit form. Further, the present invention may be employed in warehouses or distribution centers which would store large numbers of muffler bodies and nipples. Based on specific orders, the requested mufflers could be assembled at the distribution centers and delivered in final form to the users.

Although the preferred embodiments and examples of the invention has been described with reference to the foregoing specification and drawings, the scope of the invention shall now be defined with reference to the following claims.

What is claimed is:

1. A muffler nipple adapted to be threadedly secured to a bushing connected to a muffler body, said muffler nipple comprising:

a nipple portion adapted to be disposed outside of said muffler body when said muffler nipple is secured to said bushing;

a threaded portion connected to said nipple portion and adapted to threadedly engage said bushing by rotating said muffler nipple through an axis of rotation, said threaded portion including a continuous helical thread; and a shank portion between said nipple portion and said threaded portion adapted to abut and impart an axial force on said muffler body proximate to said bushing when secured thereto.

2. The muffler nipple of claim 1 wherein said continuous helical thread can produce a loosening-to-tightening torque ratio of at least approximately 60 percent.

3. The muffler nipple of claim 2 wherein said nipple portion is joined to said shank portion by interface means adapted to prevent at least some movement imparted to said nipple portion from propagating to said shank portion.

4. The muffler nipple of claim 3 wherein said interface means comprises an annular member circumferentially formed at the interface of said shank and nipple portions.

5. The muffler nipple of claim 4 wherein said annular member forms an inwardly directed groove around the interface of said shank and nipple portions.

6. The muffler nipples of claim 4 wherein said nipple portion is provided with a pair of diametrically opposed holes or notches.

7. The muffler nipple of any one of claims 1–6 wherein said helical thread is disposed at an approximate helix angle $\psi$ relative to a plane perpendicular to said axis of rotation, said thread having at least one side wall generally angled at an approximate thread angle $\alpha$ relative to said perpendicular plane, wherein said helix angle $\psi$ and thread angle $\alpha$ allow said muffler nipple to be threadedly secured to said bushing with an approximate tightening torque of at least 40 ft. lbf.

8. The muffler nipple of claim 7 wherein said shank portion is disposed at an angle $\theta$ relative to said axis of rotation.

9. The muffler nipple of claim 8 wherein said helix angle $\psi$ is between about 1 and about 20 degrees.

10. The muffler nipple of claim 9 wherein said thread angle $\alpha$ is less than approximately 60 degrees.

11. The muffler nipple of claim 10 wherein said angle $\theta$ is at least 25 degrees.

12. The muffler nipple of claim 7 wherein said helical thread winds around said threaded portion for at least one revolution.

13. In combination, a muffler nipple and muffler bushing, said muffler bushing adapted to be connected to a muffler body and said muffler nipple adapted to be threadedly secured to said muffler bushing, said muffler nipple comprising:

a nipple portion adapted to be disposed outside of said muffler body when said muffler nipple is secured to said muffler bushing;

a first threaded portion connected to said nipple portion and adapted to threadedly engage said muffler bushing by rotation of said muffler nipple through an axis of rotation, wherein said first threaded portion includes a first, continuous, helical thread; and a shank portion between said nipple portion and said threaded portion;

said muffler bushing comprising:

a connector portion adapted to be connected to said muffler body such that said shank portion abuts and imparts an axial force on said connector portion when said muffler nipple is secured to said muffler bushing; and a second threaded portion connected to said connector portion and adapted to mate with and threadedly engage said first threaded portion, wherein said second threaded portion includes a second, continuous, helical thread.

14. The muffler nipple and bushing of claim 13 wherein said first and second threads are disposed at respective first and second approximate helix angles $\psi_1$ and $\psi_2$ relative to a plane perpendicular to said axis of rotation, said first and second threads each having at least one side wall generally angled at approximate first and second thread angles $\alpha_1$ and $\alpha_2$, respectively, relative to said perpendicular plane.

15. The muffler nipple and bushing of claim 14 wherein one of said first and second helix angles $\psi_1$ and $\psi_2$ is smaller than the other of said first and second helix angles.

16. The muffler nipple and bushing of claim 15 wherein said first helix angle $\psi_1$ is approximately one-half a degree smaller than said second helix angle $\psi_2$.

17. The muffler nipple and bushing of claim 14 wherein said first thread angle $\alpha_1$ is smaller than said second thread angle $\alpha_2$.

18. The muffler nipple and bushing of claim 17 wherein said first thread angle $\alpha_1$ is approximately 10 degrees smaller than said second thread angle $\alpha_2$.

19. The muffler nipple and bushing of claim 13 wherein said second helical thread is adapted to deform when securing said muffler nipple to said muffler bushing.

20. The muffler nipple and bushing of claim 19 wherein said muffler nipple and said muffler bushing are made from a metal material, the thicknesses of the metal material in said muffler nipple and said muffler bushing being different.

21. The muffler nipple and bushing of claim 20 wherein the material of said nipple is approximately 0.02 to 0.03 inches thicker than the metal material of said bushing.

22. The muffler nipple and bushing of claim 13 wherein the outer diameter of said first thread is greater than the inner diameter of said second thread.

23. The muffler nipple and bushing of any one of claims 13–21 wherein said first and second threads produce a loosening-to-tightening torque ratio of at least approximately 60 percent.

24. The muffler nipple and bushing of claim 13 wherein said nipple portion is joined to said shank portion by interface means adapted to prevent at least some movement imparted to said nipple portion from propagating to said shank portion.

25. The muffler nipple and bushing of claim 24 wherein said interface means comprises an annular member circumferentially formed at the interface of said shank and nipple portions.

26. The muffler nipple and bushing of claim 25 wherein said annular member forms an inwardly directed groove around the interface of said shank and nipple portions.

* * * * *